US005692409A

United States Patent [19]

Cheers et al.

[11] Patent Number: 5,692,409

[45] Date of Patent: Dec. 2, 1997

[54] PRODUCTION OF METAL CONTAINERS

[75] Inventors: Christopher Francis Cheers, Wantage; Brian Hill, Swindon; Paul Porucznik, Kennington, all of United Kingdom

[73] Assignee: Carnaudmetalbox (Holdings) USA, Inc., Wilmington, Del.

[21] Appl. No.: 517,470

[22] Filed: Aug. 21, 1995

[30] Foreign Application Priority Data

Aug. 27, 1994 [GB] United Kingdom ..... 9417299

[51] Int. Cl.[6] ..... B21D 22/00; B21D 22/21; B21C 3/06

[52] U.S. Cl. ..... 72/349; 72/468

[58] Field of Search ..... 72/468, 347, 349, 72/465, 467, 285, 379.4

[56] References Cited

U.S. PATENT DOCUMENTS

| | | | |
|---|---|---|---|
| 3,656,335 | 4/1972 | Kaminski | 72/467 |
| 4,262,512 | 4/1981 | Maeder | 72/349 |
| 4,554,815 | 11/1985 | Weishalla | 72/349 |
| 4,843,863 | 7/1989 | Grims et al. | 72/349 |
| 4,926,669 | 5/1990 | Grims et al. | 72/349 |
| 5,016,462 | 5/1991 | Grims et al. | 72/349 |
| 5,235,842 | 8/1993 | Freeman et al. . | |

OTHER PUBLICATIONS

EP Search Report dated Mar. 22, 1995.
Annex to Search Report Oct. 24, 1994.

*Primary Examiner*—Lowell A. Larson
*Assistant Examiner*—Rodney A. Butler
*Attorney, Agent, or Firm*—Diller, Ramik & Wight, PC

[57] ABSTRACT

A die for the toolpack of a wall-ironing apparatus for forming metal cans is laterally displaceable for accommodating misalignment of the wall-ironing punch from its central axis. Restoring force to return the die to its own central position is provided by pneumatically operated biassing elements. For increasing the restoring force available, those biassing elements which are on the upstream side of lateral die movement are rendered ineffective on the die by engagement with stops located at the central die position. Usually, as described, the die is one of a pair of dies coupled for lateral movement together.

13 Claims, 5 Drawing Sheets

PRODUCTION OF METAL CONTAINERS

This invention relates to the production of metal containers and, in particular, to the production of thin-walled metal cans by the so-called "drawing and wall-ironing" (DWI) process.

In a DWI process, a flat circular blank is drawn through one or more drawing dies to form a shallow cup. Thereafter, the cup, which is mounted on the free end of a close-fitting punch or ram, is subjected to a second, "wall-ironing" stage by being pushed through one or more annular wall-ironing dies for the purpose of effecting an elongation of the wall of the cup.

Such elongation is produced by virtue of a very high radial compression which is generated in the wall of the cup as the cup is pushed progressively through the throat of the annular die or dies.

The most common form of tool used in this process is rigid. In this type of tool, the ironing die-rings together with associated rings, for example drawing and guiding rings, are rigidly mounted as an assembly on a machine bed. A horizontally disposed, cantilever-mounted, punch is arranged for movement in a horizontal direction along the machine bed towards and away from the die ring assembly.

It has been found that satisfactory operation of the DWI process can be upset or prevented by deflections of the cantilevered punch caused by such factors as uneven distribution of temperature around the punch surface and innacurate centering of cups on the punch. Because of these factors it can happen that the punch deflects from its desired true alignment with the longitudinal axis of the die assembly.

In order to accommodate such deflection of the punch from its desired central position, it has been proposed to mount a wall-ironing die resiliently, for example upon rubber O-rings, so that the die is able to undergo limited movement laterally, that is to say transversely of the punch axis, from a central position.

In U.S. Pat. No. 4,173,882 (Reynolds Metal Company) it is proposed that the wall-ironing die should be engaged by a series of spring fingers which engage the die around its circumference and which, due to their spring-like nature, realign the die to its normally centered position when the off-centre forces exerted on the die by the punch are removed. It will be understood that in order to achieve this effect the resultant of the biassing forces produced by the spring fingers when in its required central position on the punch axis must be substantially zero.

A disadvantage of the previously proposed methods of mounting a wall-ironing die for resilient lateral movement has been the relatively limited restoring force which has been available. For example, in the proposed arrangement of U.S. Pat. No. 4,173,882 the restoring force provided by the spring fingers will progressively increase in a substantially linear manner, ie at the spring rate, in proportion to the distance through which the die moves from its central position. The restoring forces generated when the die undergoes small lateral movement from its central position are correspondingly small, and likewise the acceleration which is imparted to the die for its return movement when the off-centre forces on the die have ceased is correspondingly limited. This limited restoring force may therefore present an upper limit to can production at very high production rates, for example greater than 300 cans per minute.

A further shortcoming of the arrangement disclosed in U.S. Pat. No. 4,173,852 is that if each spring finger is arranged to engage the die with preloading (so that it exerts a positive force on the die even when the die is in its central position), any spring finger which is disposed on the upstream side of a lateral die movement, that is to say, on the side of the die opposite to its direction of movement, will act against the one or more spring fingers in the downstream direction of movement which are seeking to restore the die to its central position. Again, therefore, the resultant restoring force exerted on the die is subject to undesired limitation.

The invention seeks to remove or substantially reduce the shortcomings noted above.

According to the present invention from a first aspect there is provided an apparatus for the production of a metal container, which comprises:

at least one die, and a punch movable through the die along an axis, the die being movable laterally in relation to the axis from a predetermined central position, and biassing means comprising a plurality of biassing elements spaced around the die at predetermined locations and each arranged for biassing the die towards the said predetermined central position when the die is laterally displaced from that position and towards the biassing element;

wherein each biassing element is ineffective upon the die when the die is laterally displaced from its central position and away from the biassing element.

According to the present invention from a second aspect there is provided an apparatus for the production of a metal container, which comprises:

at least one die, and a punch movable through the die along an axis, the die being movable laterally in relation to the axis from a predetermined central position;

biassing means for the die, the biassing means comprising a) a plurality of biassing elements spaced around the die and each subject to a force biassing the die towards its central position when the die is laterally displaced from that position and towards the biassing element, and b) fluid pressure means continuously effective to exert the said force on each said biassing element; and disabling means for the biassing means, the disabling means being arranged for rendering each biassing element ineffective upon the die when the die is laterally displaced from its central position and away from the biassing element, despite the said force continuously exerted on the biassing element by the fluid pressure means. Because of the presence of the disabling means, substantially no force opposes return of the die to its centered position (except the usual inertial forces), despite the continuous operation and availability of the biassing elements.

The biassing means is preferably operated by fluid pressure, especially pneumatic pressure, and the disabling means preferably comprises stop means providing a mechanical stop by which the disablement of each biassing element on the upstream side of lateral die displacement is effected.

In one described embodiment, the biassing elements are spaced and radially moveable pistons which are individually urged towards the punch by compressed air which may be fed from a common gallery. The die or dies are moveable laterally through a small distance to accommodate punch misalignment. Restoring force to return each die to its central position is generated pneumatically by the pistons which are individually subject to stop means by which they are made ineffective for generating force on the die when the die moves from its central position in the direction away from the piston. A very high restoring force can therefore be generated for small off-centre movements of the die. In this arrangement the stop means comprises an annulus disposed to limit the travel of the pistons in the inward direction.

In an alternative described embodiment, the biassing means comprises a plurality of segment pistons which are urged radially outwards against parts of a fixed structure by pneumatic means in the form of an air bag which is interposed between the die and the pistons.

The air bag accommodates lateral movement of the die and generates restoring force by engagement made with the fixed structure by any piston which is on the downstream side of the die movement, that is to say, in the direction of which the die is moving. A piston which is on the upstream side of the die movement, however, is lifted away from engagement with the fixed structure, so that in that region the biassing means generates no resultant inward force upon the die. Any restoring force generated by the one or more downstream pistons of the biassing means is therefore not counteracted.

In both embodiments, in the central position of the or each die no resultant lateral force is applied to the die by the biassing means. However, any lateral movement of the die from that position results in one or more of the biassing elements applying a restoring force, whilst the other biassing elements are rendered inactive. Hence, the smallest lateral movement causes a significant restoring force to be applied.

Preferably, as particularly described, first and second dies are coupled together for lateral movement in pairs, there being typically one guide ring for each die pair and one ironing ring. Coupling is achieved in the first embodiment by a forked component passing through a spacer between the dies. In the second embodiment the dies of a die pair are again separated by a spacer and they are coupled together by interlocking fingers extending from parts of a housing member by which the pistons and the air bag for each die are located.

In each embodiment very high pressure lubricant/coolant fluid is fed through the spacer between the first and second coupled dies, advantageously at a pressure of at least 500 psi, most preferably 2000 psi. The high pressure fluid forces the metal of the can onto the punch, clamping the workpiece firmly onto the punch as it enters the ironing ring. The use of such high pressures may also act to centre the punch. Careful control of the punch travel by means of the pistons and the fluid may enable an increased wall reduction of the can wall thickness to be achieved, thereby reducing the number of ironing operations required to form the finished can. The provision of the high pressure fluid has little or no effect on the centering of the dies by the biassing means as described above.

As in the first described embodiment the apparatus may have a second die pair of third and fourth dies, again typically a guide ring/ironing ring pair. In such an arrangement the apparatus may include a supply of low pressure lubricant between the two pairs of dies, ie between the second and third dies. The second and fourth dies may be sizing dies which act as guide rings.

Preferred embodiments of the invention will now be described, by way of example only, with reference to the drawings, in which.

Figure 1:
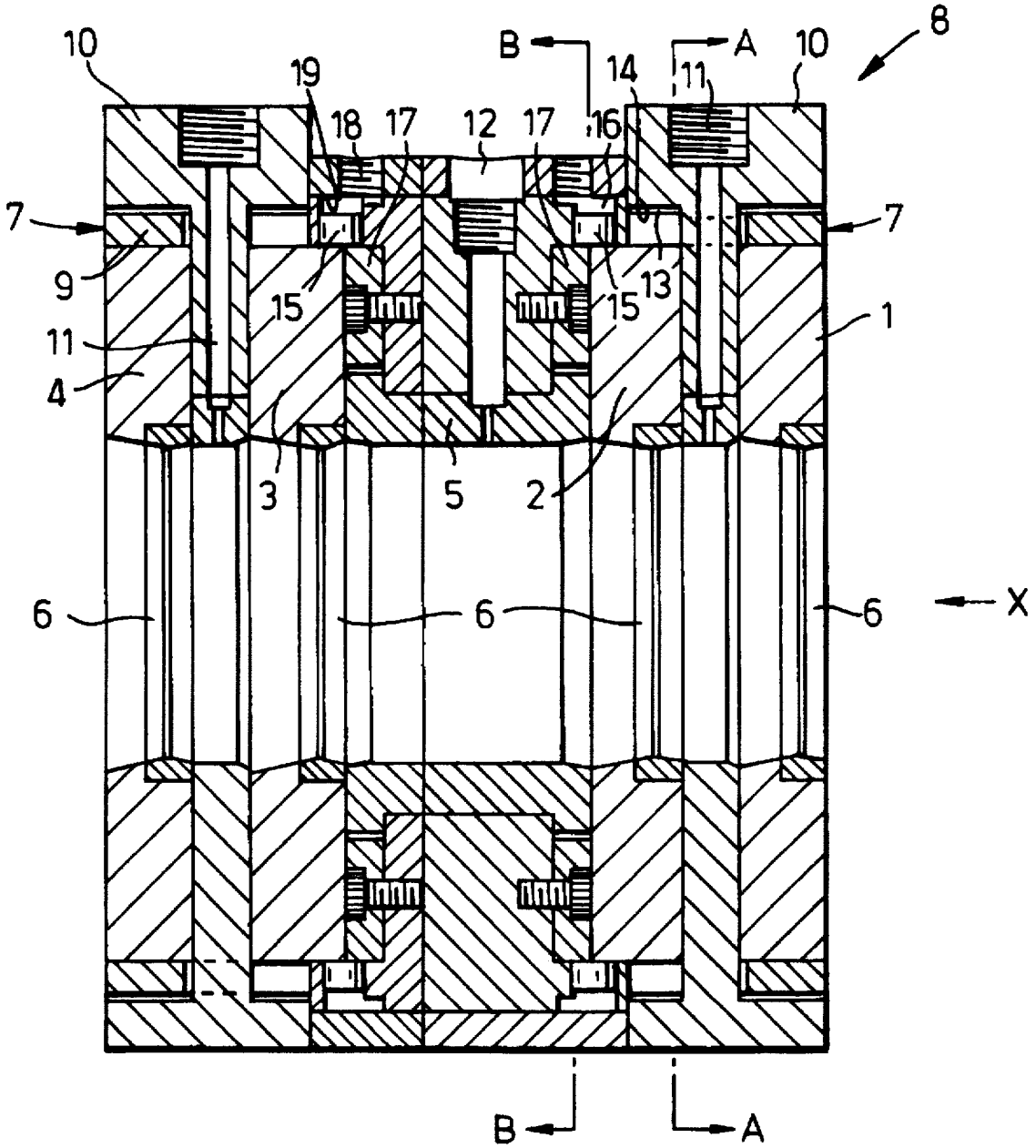
FIG. 1 is a sectional view taken on the punch axis of a die set according to a first embodiment of the invention and comprising two die pairs.

FIG. 1 is a side view of a die set 8, through which a punch passes in the direction of the arrow X in order to wall iron a can body cup carried on the punch. The die set of FIG. 1 comprises two pairs of dies 1, 2, 3 and 4, the two pairs being separated by a fixed spacer 5 in relation to which the dies are laterally movable. Each of the dies has a carbide insert 6 to provide wear resistance. Dies 1 and 3 are ironing dies, whereas dies 2 and 4 are sizing dies/guide rings. Dies 1 and 2, and dies 3 and 4 are fixed in their pairs by means of a respective forked connector 7.

For each die pair a fixed housing member 10 provides a spacer between the dies and has a central channel 11 through which high pressure coolant at typically 2000 psi is supplied to the cup exterior in order to lubricate the passage of the cup through the dies.

The spacer 5 between the pairs of dies also has a central channel 12 through which coolant is supplied, in this case at low pressure, typically 30 psi. Around the circumference of the spacer 5, two sets of cylindrical pistons 15 are provided, one set for each die pair. Each piston is located and movable within a respective radially directed chamber 16. Fixed to each side of the spacer 5 are annular piston stops 17 arranged to limit radially inward movement of the pistons 15 of the die pair on that side. Outward movement of the pistons is limited by shoulders or first step means 19 contacting second stop means "unnumbered" defined by the faces "unnumbered" of the piston 15.

For each set of pistons the piston chambers 16 are fed by a common peripheral gallery 18 from which a compressed air feed passes to the chambers 16 so as to urge the pistons 15 radially inwardly against the respective stop 17. By avoiding the need for parts which are required to flex this pneumatic biassing of the pistons eliminates or substantially limits material fatigue to a minimum.

In use, as the cantilevered punch passes through the dies, deflection of the punch from its central axial position can cause the pairs of dies to move laterally (and independantly) from their own central positions. For each die pair the available lateral movement is determined by the size of a gap 13 which is provided between the external surface of the forked connector 7 and an internal shoulder 14 of the housing 10.

In the central position of each die pair the associated pistons 15 abut not only the piston stop 17 as mentioned above but also the exterior of a die 2 or 3 of the die pair. Therefore, any lateral movement of the die pair in the direction of a piston will push the piston backwardly against the pressure of air behind it, and will lift the piston off the respective piston stop. The piston is accordingly able to exert a restoring force biassing the die pair towards its central position. This restoring force is available as soon as the piston leaves the piston stop, and its magnitude is determined by the effective area of the piston and the pressure of the air supply. It may therefore be substantially constant (and of large magnitude) over the whole travel which the piston is required to undergo until the die pair has been restored to its central position. The piston then mechanically re-engages the stop 17 and is rendered no longer effective upon the die pair.

It will thus be understood that downstream of the lateral movement of each die pair the respective pistons 15 are lifted off their stop 17 and are then effective to generate substantially constant forces in the sense to return the die pair to its central position. Any piston, however, which is located in the upstream direction of the pair movement remains engaged with the piston stop, and so can not exert any force upon the die pair. Thus the restoring forces generated on the downstream side of the die pair are not counteracted to any degree by opposing forces generated on the upstream side of the die pair. It will accordingly be seen that the stop provides a stop means by which the upstream pistons 15 are disabled from exerting or, in other words, are rendered ineffective to exert, a biassing force upon the die pair, even though they continue to generate inward force whilst the die pair is laterally displaced.

Figure 2:
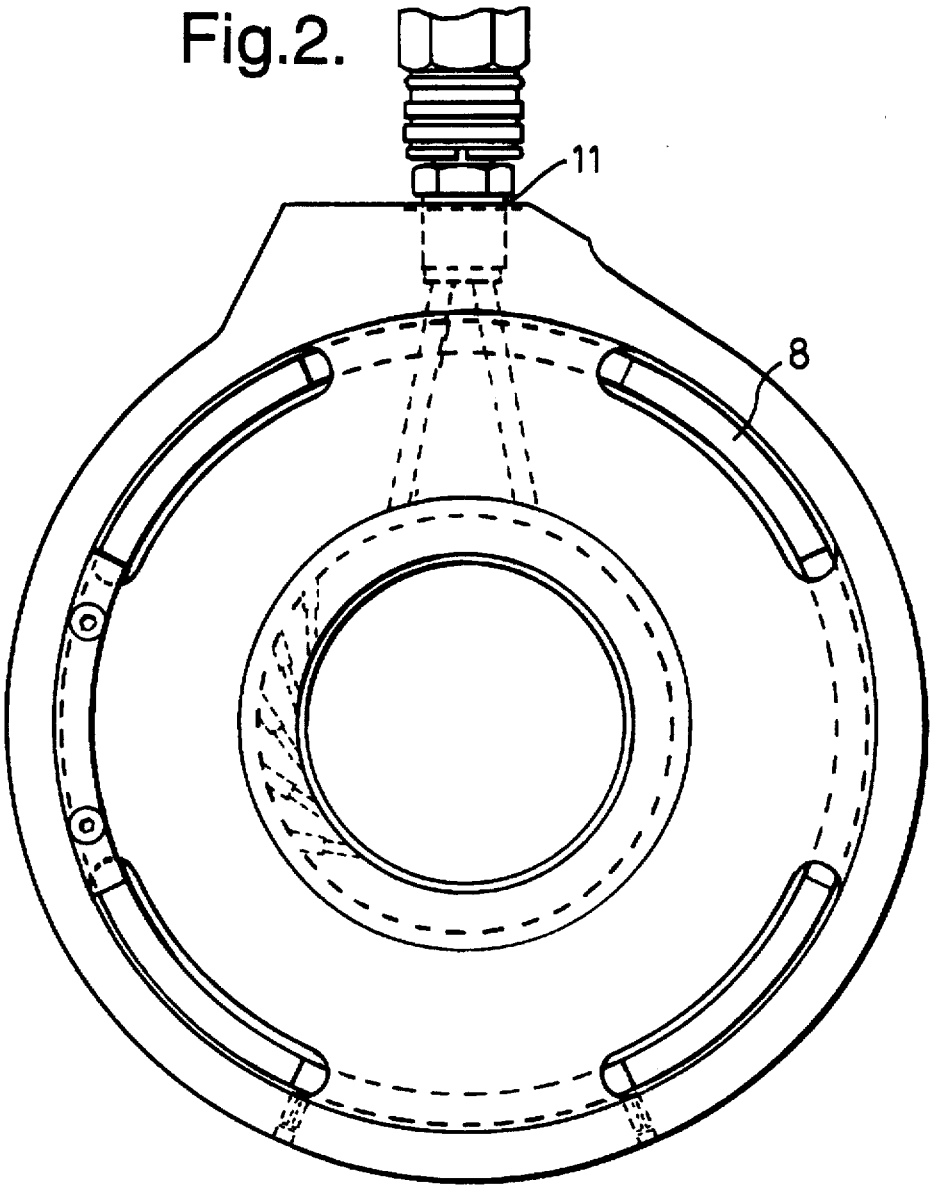
FIG. 2 is a cross-sectional view through one die pair, takenon line A—A of FIG. 1.
Figure 3:
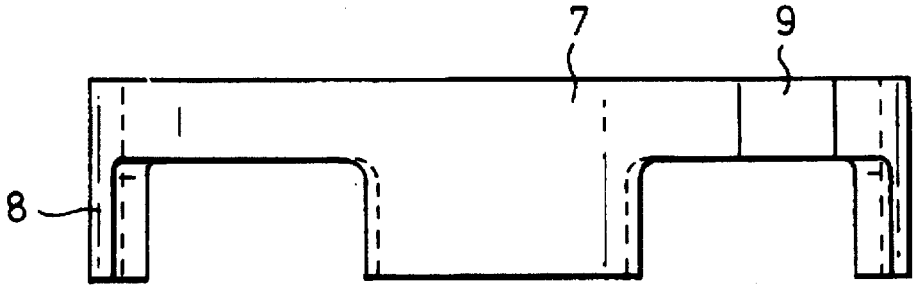
FIG. 3 is a side view of the forked connector forming part of each die pair.

FIG. 2 is a cross-section viewed in the direction of A—A of FIG. 1. In this figure, channel 11 through the housing 10 of die pair 1, 2 can be seen together with further smaller branch channels from the main channel which direct a vortex of coolant/lubricant onto the cup-punch passing through the dies. Prongs 8 of the forked connector 7 extend from an annulus 9 which forms the body of the connector and which surrounds the die 1. A cross-section of the forked connector is shown in FIG. 3.

Figure 4:
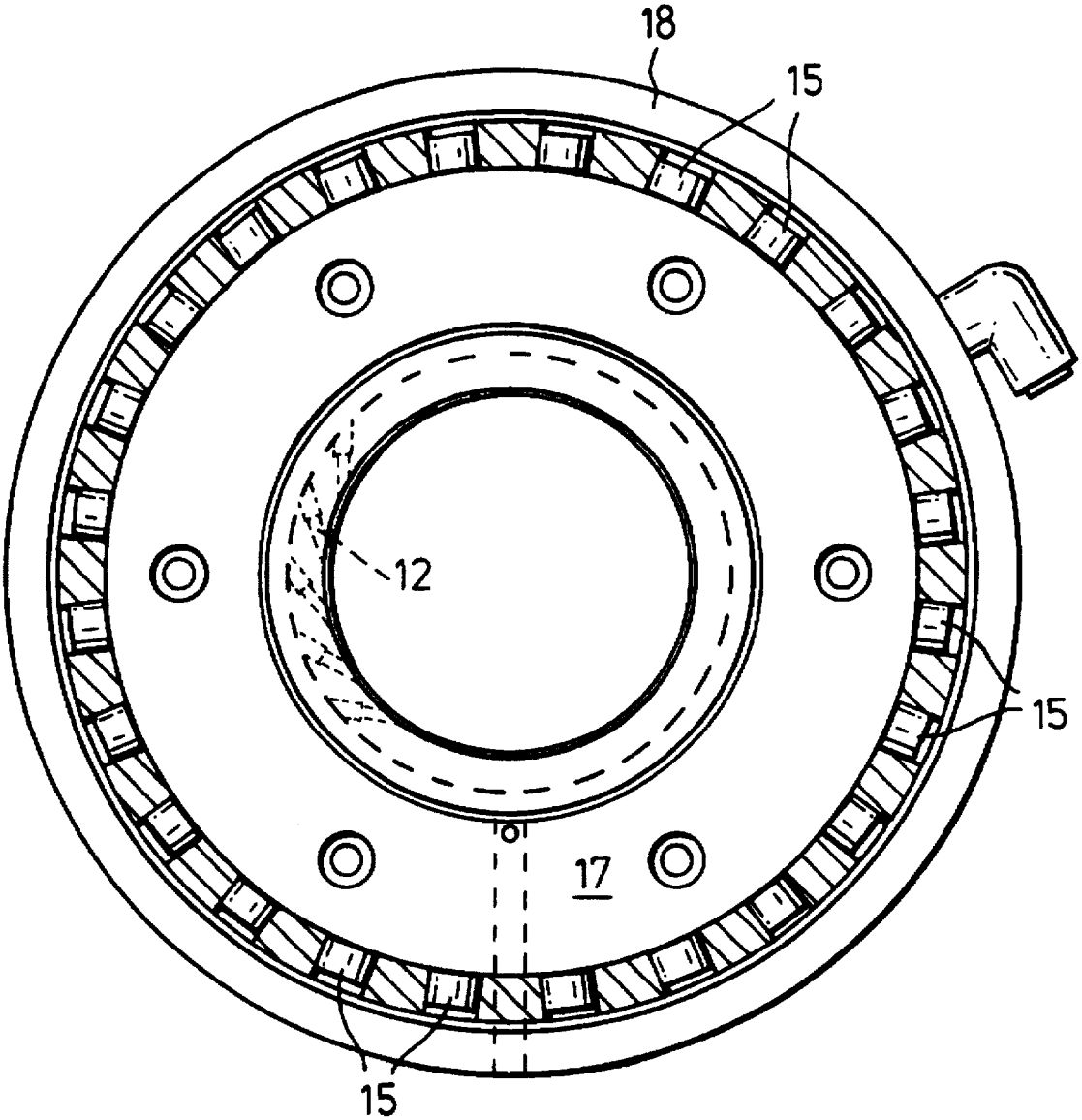
FIG. 4 is a cross-sectional view taken on line B—B of FIG. 1.

FIG. 4 is a cross-sectional view along the line B—B of FIG. 1 which passes through the pistons and looks towards the spacer 5 in the direction of punch travel. From that figure it will be understood how the compressed air is fed to the piston chambers 16 of each set by the common gallery 18. It will also be seen that 24 pistons 15 are provided, spaced regularly around the die/spacer. Within the pistons, the piston stop 17 and channels 12 for delivery of low pressure lubricant are visible.

Figure 5:
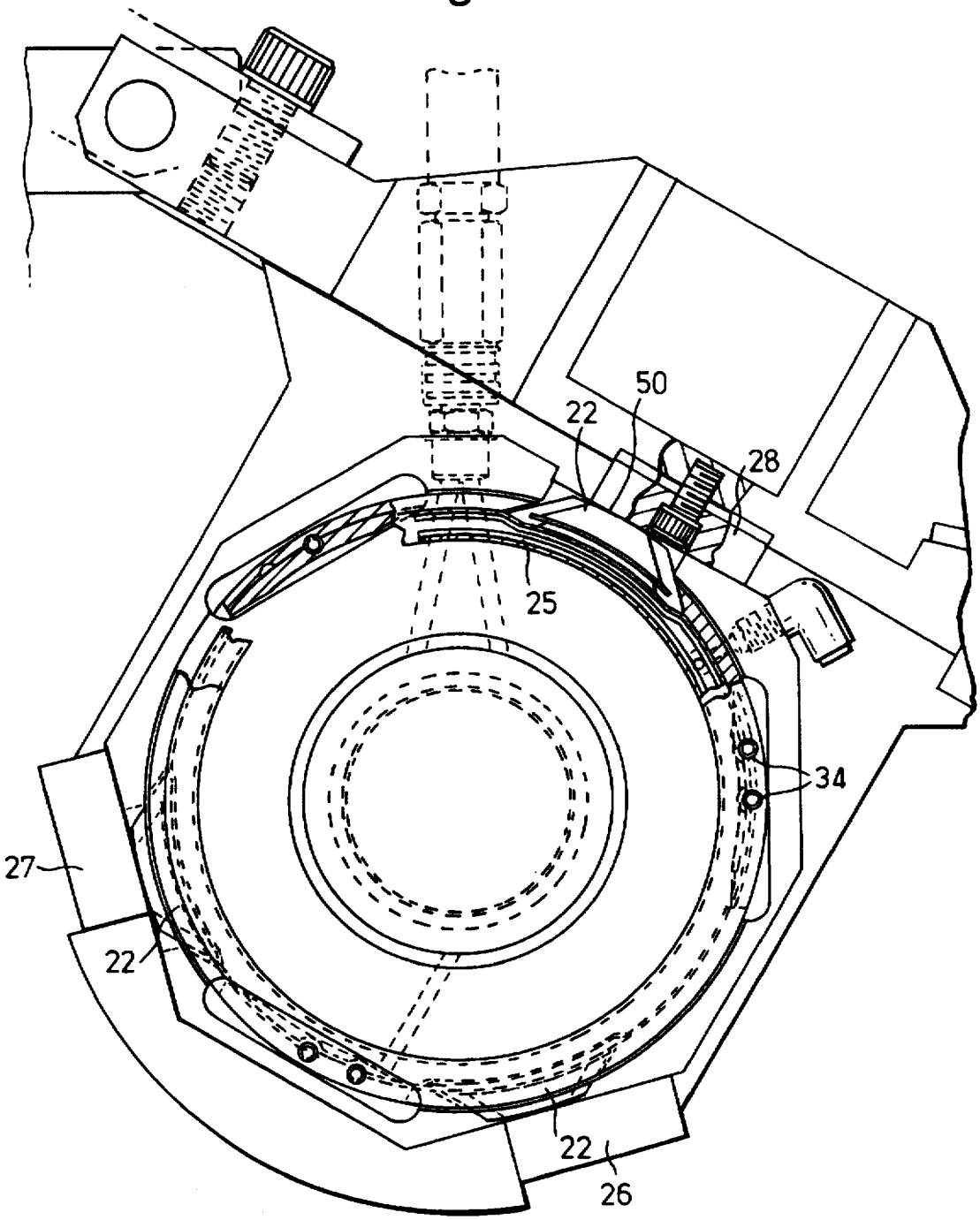
FIG. 5 is a partially scrap-sectioned view of a die pair of a second embodiment.
Figure 6:
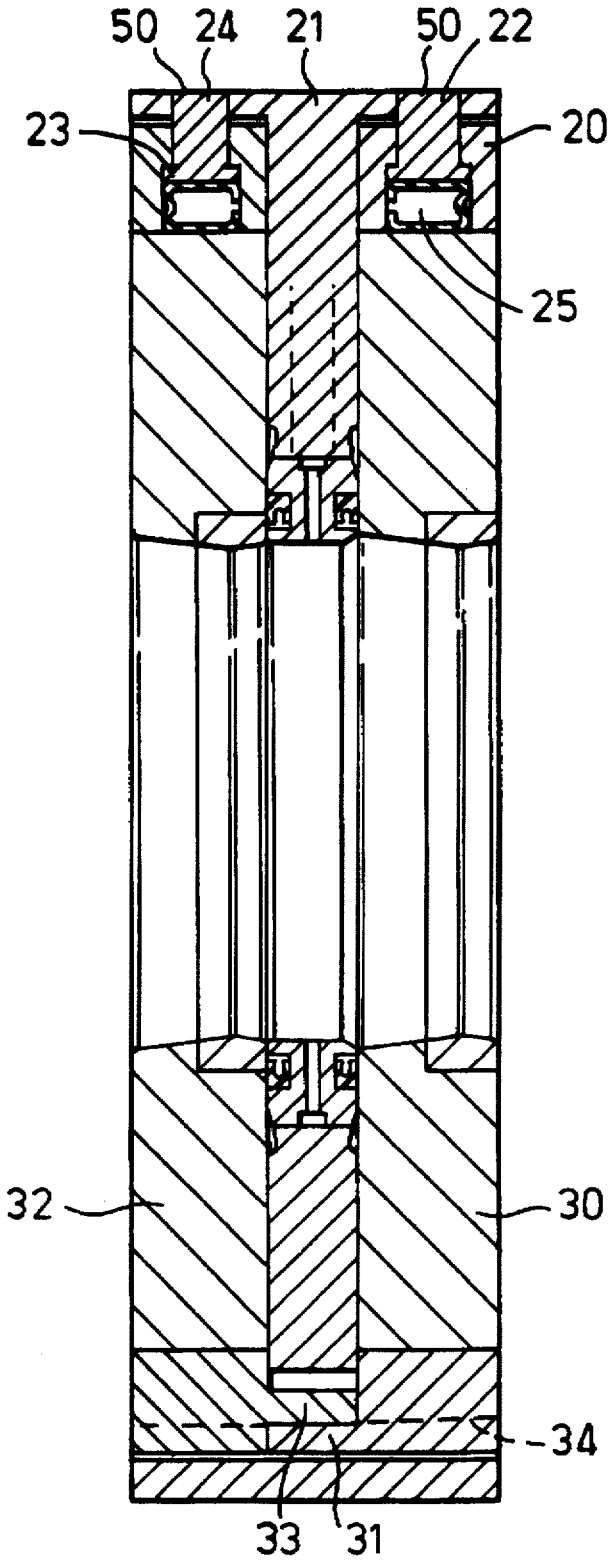
FIG. 6 is a sectioned side view of the die pair of FIG. 5.

In an alternative embodiment, illustrated in figures 5 and 6, the die rings 1, 2 of a die pair are located in an annular housing having inner and outer members 20, 21. The inner housing member 20 is itself in two parts, one for each die ring. Each part is secured to its repective die ring, and moveable with it laterally of the central axis. Trapped inside each part of the inner housing member 20 are three peripherally spaced segment pistons 22, and an air bag 25 interposed between the segment pistons and the respective die ring. Under the action of pneumatic pressure in the air bag, the pistons are urged radially outwards, and project through gaps in the housing to free ends 50. This travel is limited by engagement of flanges 23 on the segment pistons with complementary formations (not referenced) on the inside of the inner housing member 20.

As shown in FIG. 6, when the die pair is located in its aligned central position the segment pistons engage the inner housing member 20 with their flanges 23 and at the same time their free outer ends 50 engage wear bars or fixed abutment means 26, 27 and 28 forming part of the fixed structure of the apparatus. Therefore, when the die pair is deflected away from its central position, the pistons on the downstream side of the movement are pushed inwardly against the air bag and their respective flanges 23 are forced out of contact with the inner housing member. For those pistons, therefore, the compressed air bag generates a restoring force opposing further movement of the die pair away from its central position. The piston or pistons on the upstream side of the die pair movement, however, lose contact with their wear bars whilst maintaining contact at their flanges 23. They are therefore rendered incapable of transmitting inward biassing force to the die and so of counteracting any restoring force generated by the downstream pistons. As with the first embodiment, each piston 22 is able to generate maximum restoring force as soon as it is free to do so.

It will be seen that in this second embodiment the parts of the inner housing member 20 provide stop means by which the upstream segment pistons 22 are rendered ineffective to transmit biassing force to the dies, even though those segment pistons are being continuously acted upon by the air bags 25 whilst the dies are laterally displaced.

As in the first embodiment, the rings of the second embodiment are arranged in pairs comprising one ironing ring 30 and one guide ring 32. In this second embodiment, however, the rings are linked together by means of a push fit between fingers 31, 33 extending from the parts of the inner housing 20 member. The parts of the inner housing member are further secured together by means of spring pins 34 (FIG. 5).

The outer housing member 21 is generally T-shaped in cross-section and arranged to act as a spacer between the rings 30, 32. It is formed with passages for high pressure lubricant/coolant in a similar arrangement to the passages in the spacers between the dies of each die pair of the first embodiment.

We claim:

1. An apparatus for the production of a metal container comprising an annular die, a punch movable through the annular die along a punch axis, said die being movable laterally in relation to the punch axis from a predetermined central position, biassing means for biassing the die towards the predetermined central position when the die is laterally displaced from the predetermined central position and towards the biassing means, said biassing means including a plurality of spaced biassing pistons disposed exteriorly around the die at predetermined locations, fluid pressure means interposed between the die and the biassing pistons for continuously urging the biassing pistons radially outwardly away from the die, each biassing piston being located at least in part in a piston chamber under the influence of said fluid pressure means, each said biassing piston and piston chamber including respective first and second stop means which abut each other under the influence of said fluid pressure means and limit lateral outward movement of said biassing pistons relative to said piston chambers, and fixed abutment means laterally outwardly of said first and second stop means against which said biassing pistons selectively abut and release whereby upon lateral displacement of said annular die from its predetermined central position at least one biasing piston wall abut said fixed abutment means during which the associated first and second stop means will be spaced from each other and at least one further biassing piston will be spaced from said fixed abutment means during which its associated first and second stop means will be in abutment with each other thereby affecting restoration of said annular die to its punch axis relationship.

2. The apparatus as defined in claim 1 wherein said fluid pressure means include a bladder for imparting fluid pressure forces to said biassing pistons.

3. The apparatus as defined in claim 1 wherein said first stop means is a flange of each biassing piston.

4. The apparatus as defined in claim 1 wherein said second stop means is a surface of each piston chamber opposing its associated biassing piston first stop means.

5. The apparatus as defined in claim 1 wherein said first stop means is a flange of each biassing piston, and said second stop means is a surface of each piston chamber opposing its associated biassing piston flange.

6. The apparatus as defined in claim 1 including an outer housing member surrounding said biassing pistons, portions of said biassing pistons project through openings in said outer housing member, and said fixed abutment means are located exteriorly of said outer housing member.

7. The apparatus as defined in claim 2 wherein said second stop means is a surface of each piston chamber opposing its associated biassing piston first stop means.

8. The apparatus as defined in claim 2 wherein said first stop means is a flange of each biassing piston, and said second stop means is a surface of each piston chamber opposing its associated biassing piston flange.

9. The apparatus as defined in claim 2 including an outer housing member surrounding said biassing pistons, portions of said biassing pistons project through openings in said outer housing member, and said fixed abutment means are located exteriorly of said outer housing member.

10. The apparatus as defined in claim 9 wherein said second stop means is a surface of each piston chamber opposing its associated biassing piston first stop means.

11. The apparatus as defined in claim 9 wherein said first stop means is a flange of each biassing piston, and said second stop means is a surface of each piston chamber opposing its associated biassing piston flange.

12. The apparatus as defined in claim 9 including an outer housing member surrounding said biassing pistons, portions of said biassing pistons project through openings in said outer housing member, and said fixed abutment means are located exteriorly of said outer housing member.

13. An apparatus for the production of a metal container comprising an annular die, a punch movable through the annular die along a punch axis, said die being movable laterally in relation to the punch axis from a predetermined central position, biassing means for biassing the die towards the predetermined central position when the die is laterally displaced from the predetermined central position and towards the biassing means, said biassing means including a plurality of spaced biassing pistons disposed exteriorly around the die at predetermined locations, fluid pressure means for continuously urging said biassing pistons radially inwardly toward and against said die, each biassing piston being located at least in part in a piston chamber under the influence of said fluid pressure means, each said biassing piston and piston chamber including respective first and second pairs of stop means which abut each other to limit respected laterally inward and laterally outward movement of said biassing pistons depending upon the fluid pressure effect in the associated piston chamber, and all of said first pairs of stop means define the operative position of the annular die with an axis thereof coaxial to that of said punch axis whereby lateral outward movement by said annular die to release any one of said first pair of stop means automatically establishes a fluid pressure restoration force in the associated piston chamber absent correspondingly effecting the remaining biassing pistons.

* * * * *